US008671824B2

(12) United States Patent
Kauss et al.

(10) Patent No.: US 8,671,824 B2
(45) Date of Patent: Mar. 18, 2014

(54) HYDRAULIC CONTROL SYSTEM

(75) Inventors: Wolfgang Kauss, Francheville (FR); Matthieu Desbois-Renaudin, Villard de Lans (FR)

(73) Assignee: Robert Bosch GmbH, Stuttgart (DE)

( * ) Notice: Subject to any disclaimer, the term of this patent is extended or adjusted under 35 U.S.C. 154(b) by 1116 days.

(21) Appl. No.: 12/665,370

(22) PCT Filed: Jun. 20, 2008

(86) PCT No.: PCT/EP2008/004989

§ 371 (c)(1),
(2), (4) Date: Dec. 18, 2009

(87) PCT Pub. No.: WO2009/000471

PCT Pub. Date: Dec. 31, 2008

(65) Prior Publication Data

US 2010/0180761 A1 Jul. 22, 2010

(30) Foreign Application Priority Data

Jun. 26, 2007 (DE) ..... 10 2007 029 355

(51) Int. Cl.
*F15B 11/08* (2006.01)

(52) U.S. Cl.
USPC ..... 91/421; 91/436; 91/464

(58) Field of Classification Search
USPC ..... 91/436, 464, 462, 421
See application file for complete search history.

(56) References Cited

U.S. PATENT DOCUMENTS 2,946,347 A 7/1960 Ruhl
4,083,382 A 4/1978 Khatti et al.
4,184,512 A 1/1980 Pignolet
4,355,660 A 10/1982 Huffman
4,745,747 A 5/1988 Krausse et al.
4,760,866 A * 8/1988 Adler ..... 137/614.17
5,138,838 A 8/1992 Grosser
5,211,196 A * 5/1993 Schwelm ..... 137/596.2
5,259,293 A * 11/1993 Brunner ..... 91/420
5,273,069 A 12/1993 Akiyama et al.
5,305,789 A 4/1994 Rivolier (Continued)

FOREIGN PATENT DOCUMENTS

CA 2 231 498 5/1997
DE 27 51 946 7/1978

(Continued)

OTHER PUBLICATIONS

"Electro-Proportional Swivel Angle Control" Bosch Rexroth Group. Technical Data Sheet. RE 92 708 04.05 1/8 Apr. 2005.

(Continued)

*Primary Examiner* — Edward Look
*Assistant Examiner* — Michael Quandt
(74) *Attorney, Agent, or Firm* — Michael J. Striker

(57) ABSTRACT

The invention relates to a hydraulic control arrangement for supplying a pressure medium to at least one consumer. The forward line and/or the return line of the consumer comprises a distributing valve that can be continuously controlled and that has two switch positions, and a lowering brake valve that can be placed in an open position due to the pressure in the supply line. The distributing valve is in an open neutral position and can be displaced, electrically or electrohydraulically, from said neutral position into the direction of the second switch position thereof.

9 Claims, 6 Drawing Sheets

(56) References Cited

U.S. PATENT DOCUMENTS

| | | | | |
|---|---|---|---|---|
| 5,398,507 | A | 3/1995 | Akiyama et al. | |
| 5,799,485 | A * | 9/1998 | Sandau | 60/452 |
| 5,806,312 | A | 9/1998 | Kauss | |
| 5,862,831 | A | 1/1999 | Chung | |
| 5,996,623 | A | 12/1999 | Omberg | |
| 6,220,027 | B1 * | 4/2001 | Heusser | 60/422 |
| 6,305,163 | B1 | 10/2001 | Paakkunainen | |
| 6,327,959 | B1 | 12/2001 | Takahashi | |
| 6,334,308 | B1 | 1/2002 | Sato et al. | |
| 6,349,543 | B1 | 2/2002 | Lisniansky | |
| 6,367,365 | B1 | 4/2002 | Weickert et al. | |
| 6,848,641 | B2 * | 2/2005 | Lohmann et al. | 242/131 |
| 6,871,574 | B2 * | 3/2005 | Barber | 91/420 |
| 6,932,113 | B1 | 8/2005 | Kauss | |
| 7,213,501 | B2 | 5/2007 | Kauss et al. | |
| 7,263,924 | B2 * | 9/2007 | Ioku | 91/447 |
| 7,337,807 | B2 | 3/2008 | Koo et al. | |
| 7,487,707 | B2 * | 2/2009 | Pfaff et al. | 91/437 |
| 7,634,961 | B2 | 12/2009 | Asakage et al. | |
| 2002/0050295 | A1 | 5/2002 | Fiala et al. | |
| 2003/0106420 | A1 | 6/2003 | Yoshino | |
| 2004/0237773 | A1 * | 12/2004 | Mentink | 91/465 |

FOREIGN PATENT DOCUMENTS

| | | |
|---|---|---|
| DE | 34 22 978 | 1/1986 |
| DE | 37 09 504 | 10/1988 |
| DE | 43 08 004 | 10/1993 |
| DE | 196 08 801 | 9/1997 |
| DE | 198 31 595 | 1/2000 |
| DE | 199 48 232 | 1/2001 |
| DE | 199 49 802 | 4/2001 |
| DE | 199 58 257 | 6/2001 |
| DE | 103 25 294 | 12/2004 |
| DE | 10 2005 928 | 6/2006 |
| EP | 0 566 449 | 10/1993 |
| EP | 1 092 095 | 4/2001 |
| EP | 1 170 510 | 1/2002 |
| EP | 1 691 083 | 8/2006 |
| EP | 1 813 821 | 8/2007 |
| JP | 3-51201 | 5/1991 |
| WO | 90/10795 | 9/1990 |

OTHER PUBLICATIONS

"Variabale Displacement Pump A10VO" Series 5, Open Circuits, SAE-Version, Axialpiston, Swash Plate Design. RE 92703/04.96. Mannesmann Rexroth. Apr. 1996.

"Counterbalance, Standard Poppet Type Differential Area Special Cavity" VBSO-SEC-42, 04.52.12-X-99-Z. Sep. 2005.

RE 64 552: "Hydralisches Vorsteuergeraet in . . ." Bosch Rexroth AG, May 2006, pp. 1-8.

Rexroth Bosch Group, RE 64 295/07.02: "LUDV Control Block of Mono and Sandwich Plate Design Type M7-22" Jul. 2002 (With English Translation).

Mannesmann Rexroth RE 64 282/05.00: "High Pressure Load Sensing Control Block of Sanwich Plate Design Type M4-15" May 2000 (With English Translation).

* cited by examiner

HYDRAULIC CONTROL SYSTEM

CROSS-REFERENCE

The invention described and claimed hereinbelow is also described in PCT/EP2008/004989, filed on Jun. 20, 2006 and DE 10 2007 029 355.2, filed on Jun. 30, 2007. This German Patent Application, whose subject matter is incorporated here by reference, provides the basis for a claim of priority of invention under 35 U.S.C. 119 (a)-(d).

BACKGROUND OF THE INVENTION

The invention relates to a hydraulic control system for supplying pressure fluid to at least one consumer.

For example, U.S. Pat. No. 5,138,838 A has disclosed a control system of this kind. In this control system, a consumer, for example a differential cylinder, is supplied via a valve device with pressure fluid that is furnished by a pump. The supply to the consumer and the return from it each contain a respective continuously adjustable directional control valve. In their neutral positions, the directional control valves are prestressed into a closed position and, by means of pressure reduction valves, can each be moved in one direction in which the pump is connected to the associated pressure chamber and in another direction in which the respective associated pressure chamber is connected to the tank. In this known control system, through suitable triggering of the two directional control valves, the consumer can be operated with a so-called regeneration circuit. For example, when a cylinder travels outward, the contracting annular chamber is connected via the associated directional control valve to the pressure fluid inlet of the expanding annular chamber so that the cylinder is extended in a rapid movement. A disadvantage of the regeneration/differential circuit, however, is that due to the restraining of the consumer (effective area corresponds to the piston rod area with equal pressures in the annular chamber and cylinder chamber), the consumer cannot be operated with the maximum output.

A control system of this kind also requires a relatively high apparatus complexity since the directional control valves are embodied in the form of 3-position valves and a respective pressure reduction valve must be provided for each movement direction.

SUMMARY OF THE INVENTION

The object underlying the present invention is to create a hydraulic control system that can be operated in a regeneration circuit with a low apparatus complexity.

According to the invention, the hydraulic control system is embodied with a continuously adjustable valve device via which a pressure chamber on the supply side of the at least one consumer can be connected to a pump and via which a pressure chamber on the return side of the consumer can be connected to a tank. This valve device has a respective load lowering valve that is situated in the inlet and/or in the return and is associated with a continuously adjustable directional control valve, which, by contrast with the prior art mentioned at the beginning, has two switching positions and is prestressed into an open neutral position. In other words, actuating the directional control valve requires only one proportional magnet or one electrically pilot-controlled pressure reduction valve since in the unactuated state, the associated pressure chamber is connected either to the pump or—preferably—to the tank and when the directional control valve is moved in the direction of the other switching position, the pressure fluid connection to the pump is opened. The use of the load lowering valve prevents the occurrence of cavitations in the case of a pulling load. In the case of a pushing load, the pressure in the supply is used to open the load lowering valve situated in the return. If the consumers do not require any pressure fluid, then the load lowering valve supports the respective load in a leakage-free fashion. By contrast with the prior art, in the embodiment according to the invention, at least one load lowering valve does in fact have to be provided, but its price is lower than that of the proportional magnet whose elimination it enables so that the control system can be implemented for a more reasonable price than in conventional embodiments. The directional control valve permits the individual adjustment of the volumetric flow of pressure fluid in the supply and return.

Load lowering valves are known from the prior art, for example from DE 196 08 801 C2 or from the data sheet VPSO-SEC-42; 04.52.12-X-99-Z from the company Oil Control, a subsidiary of the applicant. A load lowering valve is in principle a stop valve that can be unlocked by means of the pressure in the inlet and permits a controlled lowering in the case of a pushing load.

In one exemplary embodiment, a respective load lowering valve and a continuously adjustable directional control valve are situated in the supply and in the return.

Each load lowering valve can be bypassed in the supply direction via a bypass line with a check valve.

It is preferable according to the invention if the load lowering valve is embodied with a pressure limiting function so that it functions as a secondary pressure limiting valve in order to limit the pressure in the associated pressure fluid flow path to a maximum value set at the load lowering valve.

In a preferred variant of the load lowering valve, a slider is prestressed into a closed position by a spring and the spring chamber is discharged to the atmosphere.

For the regeneration, the control unit can move the two 3/2-port directional control valves into a position in which the supply-side pressure chamber and return-side pressure chamber of the consumer are both connected to the pump.

In the embodiment according to the invention, it is preferable if the load lowering valve is situated downstream of the respective directional control valve in the supply direction.

The control unit can be embodied in a particularly compact fashion if it is situated in the valve unit on the housing of the consumer or is integrated into this housing.

The pump of the control unit is preferably embodied as electrically or electrohydraulically adjustable and is provided with a pressure regulation.

The triggering signal for a pump controller in this case is a measure for the swivel angle. This requirement is met, for example, by means of so-called EP or EK pump controllers with electroproportional swivel angle control.

Other advantageous modifications of the invention are the subject of additional dependent claims.

Details regarding the pump control are described in the patent application "Hydraulic Control System" that was filed in parallel with the present one so that only those features of the pump control essential to comprehension of the invention are described in the present application. For further details, the reader is referred to the patent application that the applicant has filed in parallel. The disclosure of this parallel-filed application is fully part of the present application.

BRIEF DESCRIPTION OF THE DRAWINGS

A preferred exemplary embodiment of the invention will be explained in greater detail below in conjunction with schematic drawings.

DETAILED DESCRIPTION OF THE PREFERRED EMBODIMENTS

Figure 1:
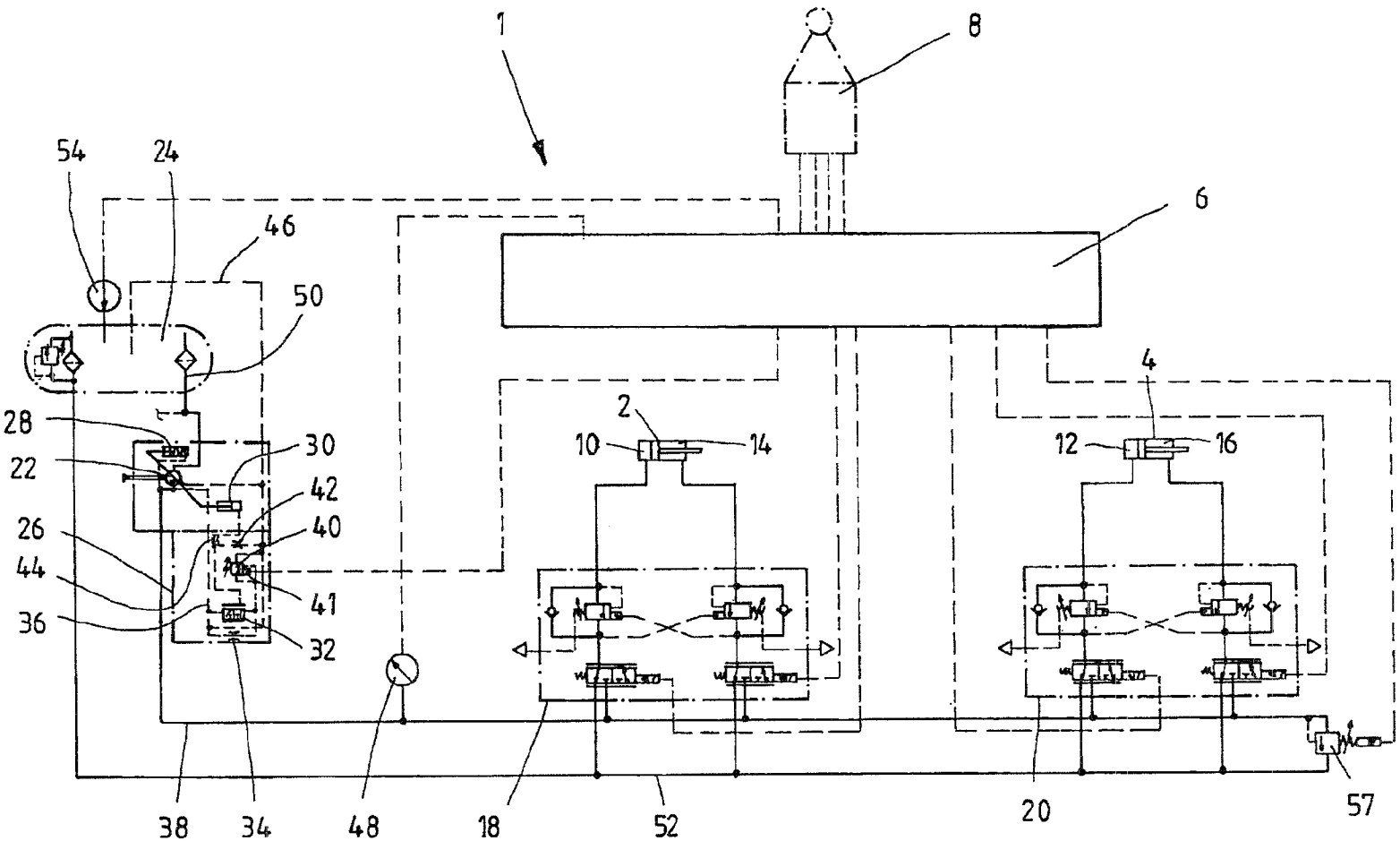
FIG. 1 is a schematic circuit diagram of a control system according to the present invention for supplying pressure fluid to a plurality of consumers.

FIG. 1 shows a hydraulic control system 1 for supplying pressure fluid to two consumers 2, 4 of a piece of mobile equipment such as an excavator, a backhoe loader, a mini- or compact excavator, or a telehandler. It is a so-called EFM system (electronic flow management) in which the valve elements that determine the volumetric flow of pressure fluid and the flow direction of the pressure fluid are triggered as a function of characteristic curve families stored in a control unit 6. In this case, the setpoint values are input by means of a joystick 8 that is actuated by the operator in order to control the speed and position of the machine components (e.g. booms, shovels) of the piece of equipment.

In the exemplary embodiment shown, the two consumers 2, 4 are each embodied in the form of a differential cylinder with a pressure chamber 10 or 12 at the bottom and an annular chamber 14 or 16 around the piston rod. These pressure chambers 10, 14; 12, 16 can be respectively connected via a directional control valve section 18, 20 to a variable displacement pump 22 or a tank 24 in order to retract or extend the cylinder. The variable displacement pump 22 is pressure-controlled by means of a pump controller 26, which, once the predetermined pressure has been reached, adjusts the delivery rate of the pump so that the pressure in the system remains constant independent of the delivery rate. A change in the volumetric flow of the pressure fluid should result in practically no change in pressure.

The variable displacement pump 22 is acted on in the direction of the maximum volumetric flow of pressure fluid (maximum swivel angle) by a spring-actuated return cylinder 28 and is acted on in the direction of the reduction in the volumetric flow of pressure fluid by an actuating cylinder 30. The pressure chamber of the actuating cylinder 30 acting in the direction of the reduction in the volumetric flow of pressure fluid can be acted on with either the pump pressure or the tank pressure via a pump control valve 32 embodied with three connections. The pump control valve 32 is acted on in the direction of a connection of the pressure chamber of the actuating cylinder 30 to the tank 24 by a control spring and by the pressure downstream of a nozzle 34 that is situated in a control line 36 via which the pressure in a pump line 38 attached to the pressure connection of the variable displacement pump 22 is tapped. This pressure also acts in the direction of a connection of the pressure chamber of the actuating cylinder 30 to the pump pressure at the pump control valve 32. The region of the control line 36 situated downstream of the nozzle 34 can be connected to the tank 24 via a pressure limiting valve 40. This pressure limiting valve 40 is electrically supplied with current via a signal line connected to the control unit 6. In its spring-prestressed home position shown here, the pressure limiting valve 40 closes off the control oil connection to the tank 24.

The pump controller 26 is set so that an adjustment of the swivel angle is only possible starting from a standby pressure of 20 bar.

In the spring-prestressed home position of the pump control valve 32, the pressure chamber of the actuating cylinder 30 is connected via two additional nozzles 42, 44 to a tank control line 46 leading to the tank. When the pressure limiting valve 40 is opened, the region of the control line 36 situated downstream of the nozzle 34 is connected via the pressure limiting valve 40 to the tank control line 46 so that the pump control valve 32 in the depiction shown in FIG. 1 is moved toward the right by the pump pressure and the pressure fluid connection between the pressure chamber of the actuating cylinder 30 and the control line 36 is opened. The control oil can then flow via the pump control valve 32 and the nozzle 44 to the actuating cylinder 30 so that the buildup of pressure in the pressure chamber of the actuating cylinder 30 causes the swivel angle to decrease until the pump pressure preset by means of the control unit 6 is achieved. Further explanations of the function of the pump controller 26 are unnecessary since the basic design of such pressure regulators is described, for example, in the data sheet RD 92 703 from Bosch Rexroth AG. In lieu of a pressure regulator, it is also possible to use other controllers such as electroproportional swivel angle controllers (EP or EK). Such controllers are described in the data sheet RD 92 708 from Bosch Rexroth AG; for further details, the reader is referred to the explanations given therein.

The pressure in the pump line 38 is detected by a pressure sensor 48 and reported to the control unit 6 via a signal line.

The suction connection of the variable displacement pump 22 is connected to the tank 24 via a suction line 50 and a filter. The pressure fluid supplied by the variable displacement pump 22 flows to the consumers 2, 4 via the pump line 38 and the two directional control valve sections 18, 20, whose design is explained below in conjunction with FIG. 2. On the return side, the pressure fluid flows from the consumers 2, 4 to the tank 24 via the associated directional control valve sections 18, 20 and a tank line 52; in the end section of the tank line 52, an additional filter is provided, which can be bypassed via a pressure limiting valve that opens when the filter becomes clogged and the pressure loss induced by the filter rises as a result.

The temperature of the pressure fluid contained in the tank 24 is detected by a temperature sensor 54 and reported to the control unit 6 via a signal line. In order to prevent an overheating of the pressure fluid, a purge valve 57 is provided between the tank line 52 and the pump line 38. This purge valve 57 also has a pressure limiting function that makes it possible to limit the pressure in the pump line 38 to a maximum pressure. When the purge valve 57 is opened, the pressure fluid used to actuate the consumer, particularly in the regeneration circuit, can be exchanged for "fresh" pressure fluid from the tank 24. The opening of the purge valve 57 is likewise executed electrically as a function of a signal from the control unit 6.

Figure 2:
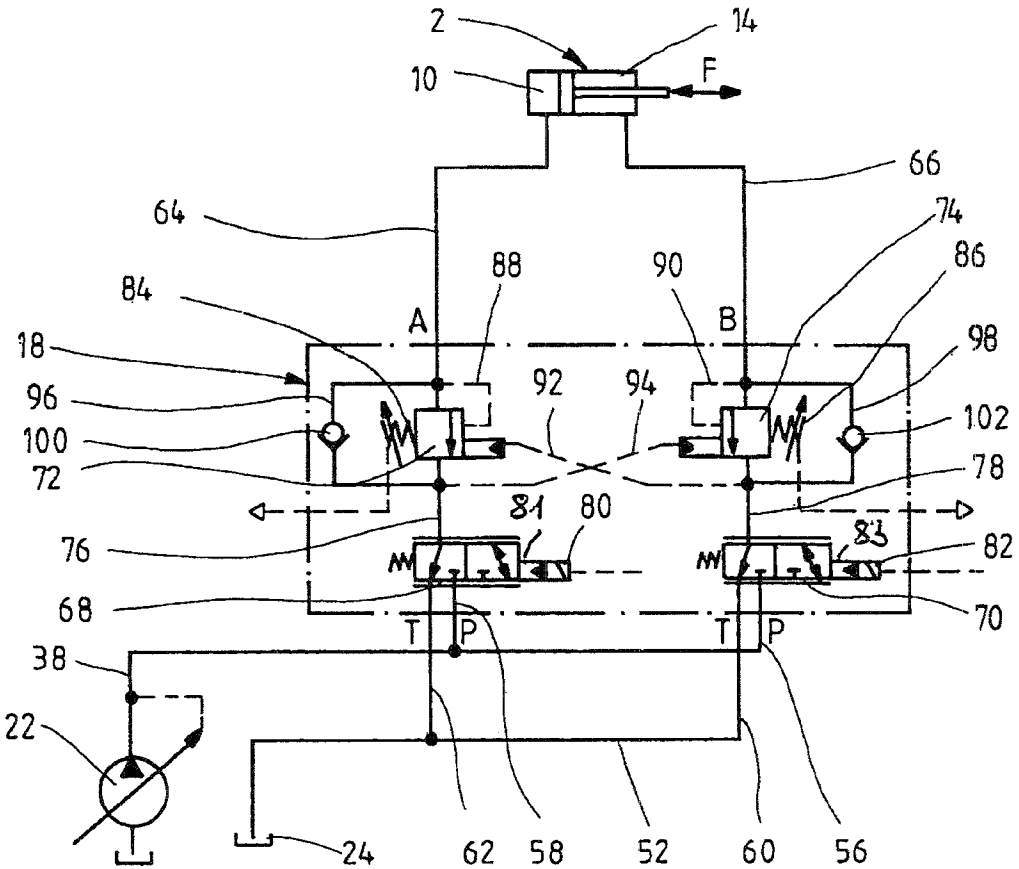
FIG. 2 is a detail view of a directional control valve section of the control system, which valve section is associated with one consumer and is in a neutral position.

FIG. 2 shows the basic design of the two directional control valve sections 18, 20; the directional control valve segment 18 is shown by way of example and the variable displacement pump 22 and tank 24 are schematically depicted.

According to FIG. 2, the directional control valve section 18 has two pressure connections P that are each connected to the pump line 38 via a respective inlet line 56, 58. Two tank connections T of the directional control valve section 18 are connected to the tank line 52 via outlet lines 60, 62. Each connection pair P, T of the directional control valve section 18 is associated with a respective working connection A or B, each of which is connected via a respective supply line 64 or return line 66 to the pressure chamber 10 or annular chamber 14 of the consumer 2. The pressure fluid flow paths between the connections P, T and the associated working connections A, B each contain a respective continuously adjustable 3-port directional control valve 68, 70, which has two switching positions and three connections, and a respective load lowering valve 72, 74. Each directional control valve 68, 70 is prestressed by a control spring into its depicted neutral position in which a pressure fluid connection is open between the outlet line 60, 62 and a connecting conduit 76, 78 that respectively extends to the adjacent load lowering valve 72, 74.

Figure 3:
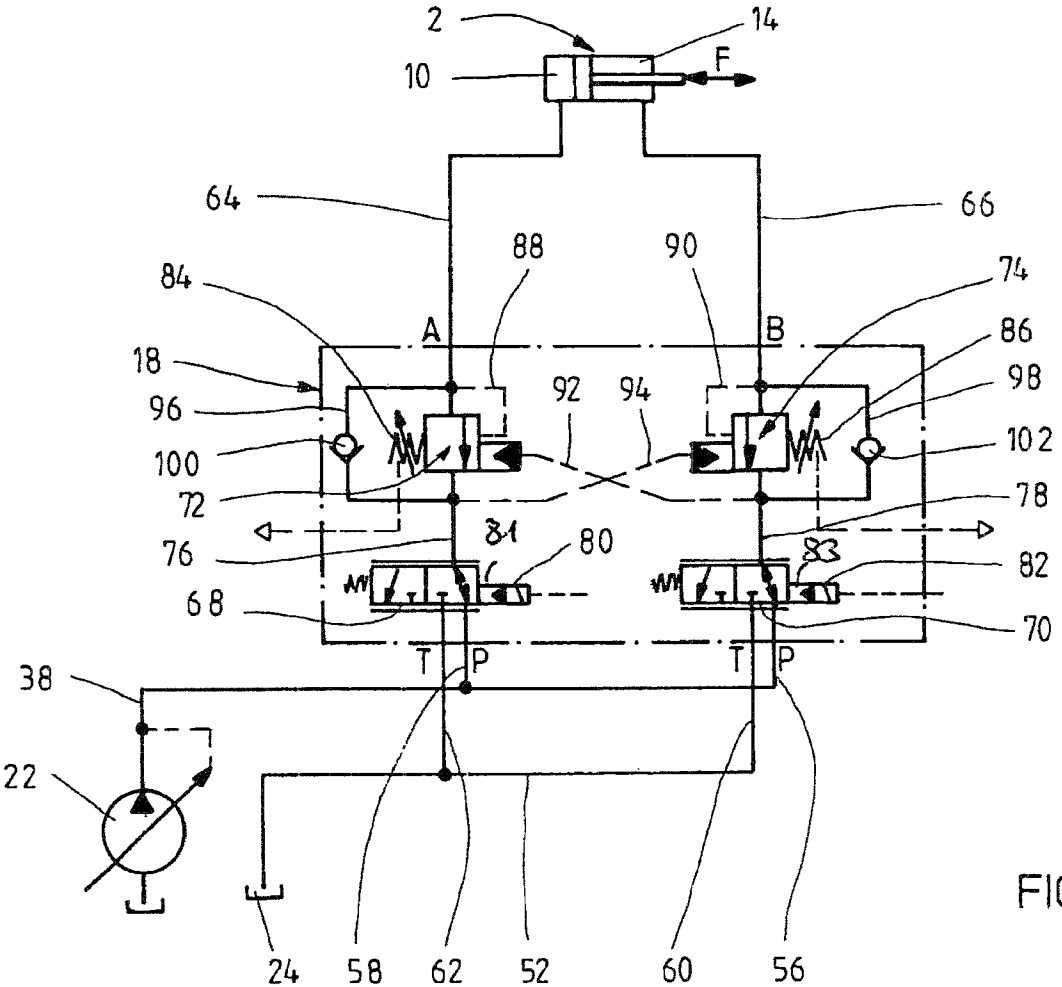
FIG. 3 shows the control system according to FIG. 2 when the cylinder is extending, during regeneration and with a pulling or pushing load.

Each directional control valve 68, 70 is adjusted by means of a respective pilot valve 81, 83 with a proportional magnet 80, 82 that can be supplied with current by the central control unit 6 via signal lines in order, by adjusting the pilot valves 81, 83, for example of pressure reduction valves, to move the directional control valve 68, 70 independently of each other in the direction of their position shown in FIG. 3 in which the pressure fluid connections are opened between the inlet lines 56, 58 and the connecting conduits 78, 76. Consequently, the two directional control valves 68, 70, with their neutral position that is open in relation to the tank 24, have an extremely simple design in which by contrast with the prior art described at the beginning, only one pilot valve and one proportional magnet 80, 82 are required to execute the movement, whereas in the known embodiments with a closed neutral position, it is necessary to use two expensive proportional magnets and two pilot valves. In principle, the directional control valves 68, 70 can also be triggered directly by means of the proportional magnets.

The two load lowering valves 72, 74 have an intrinsically known design of the kind described, for example, in DE 196 08 801 C2, or in the data sheet VPSO-SEC-42; 04.52.12-X-99-Z from the company Oil Control, both of which were mentioned at the beginning. Load lowering valves of this kind permit the controlled lowering of a load and simultaneously function as a secondary pressure limiting valve. To that end, the load lowering valves are prestressed into a closed position by means of an adjustable prestressing spring 84, 86. As shown in FIG. 2, the spring chambers of the two prestressing springs 84, 86 are vented toward the atmosphere. The respective pressure at the associated working connection A, B, which is tapped by means of a respective pressure limiting control line 88, 90, acts in the opening direction. The pressure in the respective other connecting conduit 76, 78, the so-called "cross-over", which is tapped by means of opening lines 92, 94, also acts in the opening direction. Furthermore, the two load lowering valves 72, 74 can also provide leakage-free support to the load acting on the consumer 2. The supply of pressure fluid from the directional control valve 68, 70 to the respective pressure chamber of the consumer 2 takes place via a respective bypass conduit 96, 98 that connects the connecting conduit 76, 78 to the respective supply line 64, 66; each bypass conduit 96, 98 contains a check valve 100, 102 that opens in the direction toward the consumer 2.

In the neutral positions—depicted in FIGS. 1 and 2—of the two directional control valves 68, 70, the two pressure chambers of each consumer 2, 4 are connected to the tank 24. The load F acting on the consumer 2 is supported in a leakage-free fashion by the load lowering valve 72, 74, which is embodied in the form of a seat valve. In this case, the load F can be in the form of a pulling or pushing load. The pressure limiting function of the two load lowering valves 72, 74 ensures that a maximum pressure cannot be exceeded in the lines 64, 66.

Several load situations will be explained below to better illustrate the invention.

Let us first assume that a pulling load F is acting on the cylinder 2 and that according to the depiction in FIG. 3, the cylinder is to be extended (movement toward the right). This extending motion should occur at a maximum speed (rapid movement). For this purpose, the two directional control valves 68, 70 are moved in the direction toward the position shown in FIG. 3 in which a regeneration occurs. In other words, the consumer 2 is triggered by means of a differential circuit in which both the annular chamber 14 and the bottom pressure chamber 10 are connected to the pump 22. To accomplish this, the two proportional magnets 80, 82 move the directional control valves from the neutral position (FIG. 2) toward the left so that both pressure connections P of the directional control valve section 18 are connected to the connecting conduits 76, 78. The pump 22 supplies the pressure fluid into the expanding bottom pressure chamber 10 via the pressure connection P, the directional control valve 68, the connecting line 76, the bypass conduit 96, the check valve 100, and the supply line 64. The pressure fluid displaced from the annular chamber 14 flows via the return line 66, the load lowering valve 74 that the pressure in the connecting conduit 76 has completely opened in the pressure limiting function, the connecting conduit 78, and the directional control valve 70, to the inlet line 56 and from there, into the pump line 38 so that the volumetric flow of pressure fluid emerging from the consumer is added to the volumetric flow of pressure fluid delivered by the pump 22.

In the bottom pressure chamber 10, a pressure is present, which after the slider is set, lies between the maximum pump pressure (for example 250 bar) and 0 bar (slider in the neutral position). If one assumes that the pressure in the annular chamber 14 is approximately 250 bar (slider of the directional control valve 70 completely open, pump set to 250 bar) and that the pulling load corresponds to a pressure of 50 bar, then the bottom pressure chamber 10 must contain a pressure that equals the difference of the pressure in the annular chamber 14 minus the load, divided by the area ratio of the differential cylinder (for example 2) so that 250 bar in the annular chamber 14 and a load of 50 bar results in a pressure of approximately 100 bar in the pressure chamber 10.

With a pushing load, an equivalent function occurs in which the pressure in the supply-side supply line 64 is limited by the pressure limiting function of the load lowering valve 72.

Figure 4:
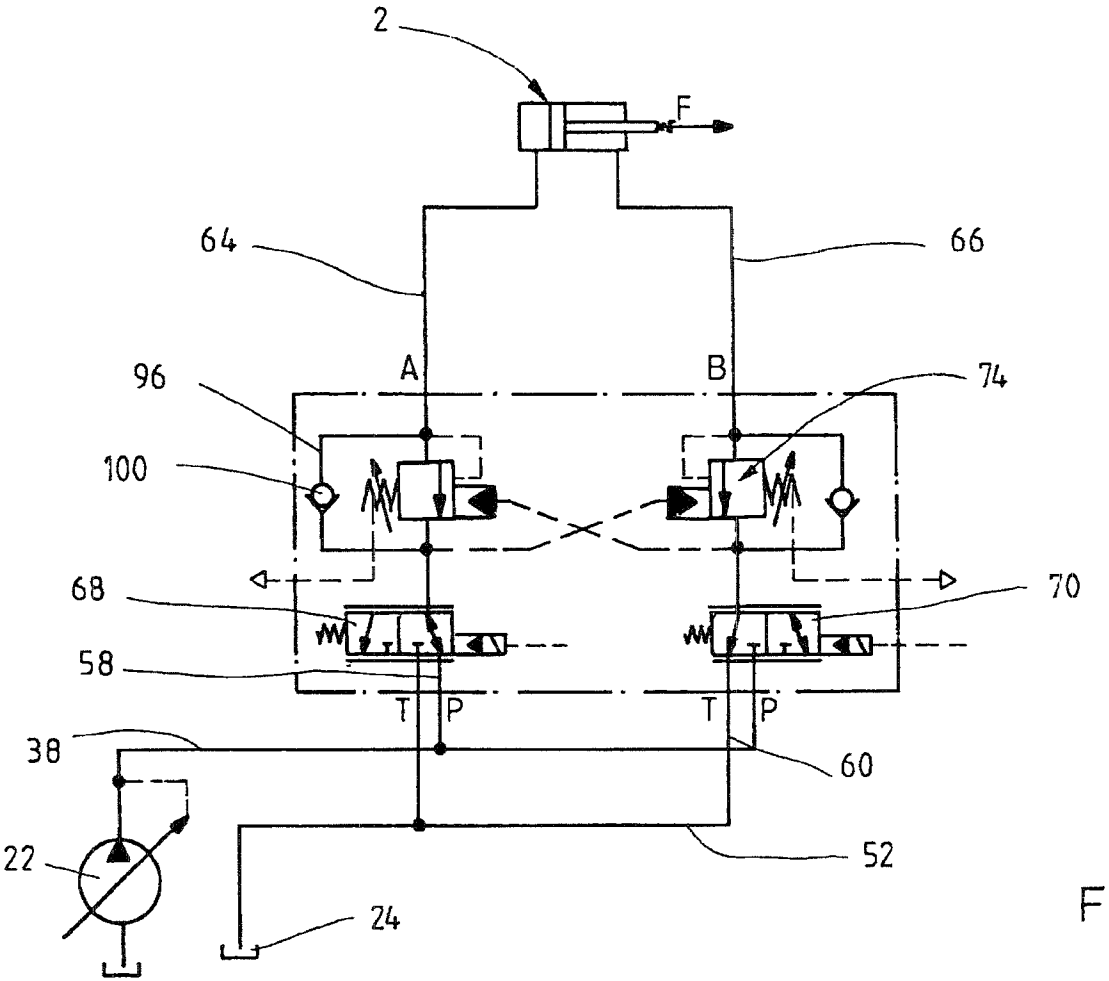
FIG. 4 shows the load situation according to FIG. 3 without regeneration.

In regeneration mode, the consumer is moved at maximum speed; the force exerted by the consumer, however, is comparatively slight because the effective area of the consumer corresponds to the piston rod area. In order to trigger the maximum output of the consumer 2, the control system is switched from regeneration mode to the normal operating mode shown in FIG. 4 by moving the directional control valve 70 in the direction of its neutral position so that the pressure fluid flows out of the annular chamber 14 to the tank 24 via the return line 66, the open load lowering valve 74, the connecting conduit 78, and via the directional control valve 70 and the outlet line 60. With a pulling load (FIG. 4), cavitations in the vicinity of the supply line 64 are reliably prevented by means of the load lowering valve 74 since this valve, by restraining the consumer 2, prevents an uncontrolled, excessively rapid extending motion of the consumer 2 as a result of the pulling load. In this case, the maximum pressure in the return line 66 is limited by the secondary pressure limiting function of the load lowering valve 74. The pressure in the pressure fluid supply is in turn determined by means of the opening cross section established by the slider of the directional control valve 68 and consequently lies between 0 bar and the maximum pump pressure (for example 250 bar).

With a pushing load and an extending cylinder 2 (FIG. 4), depending upon the slider position of the directional control valve 68 and the triggering of the variable displacement pump 22, a pressure occurs in the bottom pressure chamber 10 that lies between the load pressure and the maximum pump pressure (consumer against stop). The load lowering valve 74 situated in the return is opened completely by the pressure in the inlet (tapped via the opening line 94) so that the pressure fluid can flow out of the annular chamber 14 and into the tank 24. In this load situation, no regeneration mode is provided and there is no danger of cavitations.

Figure 5:
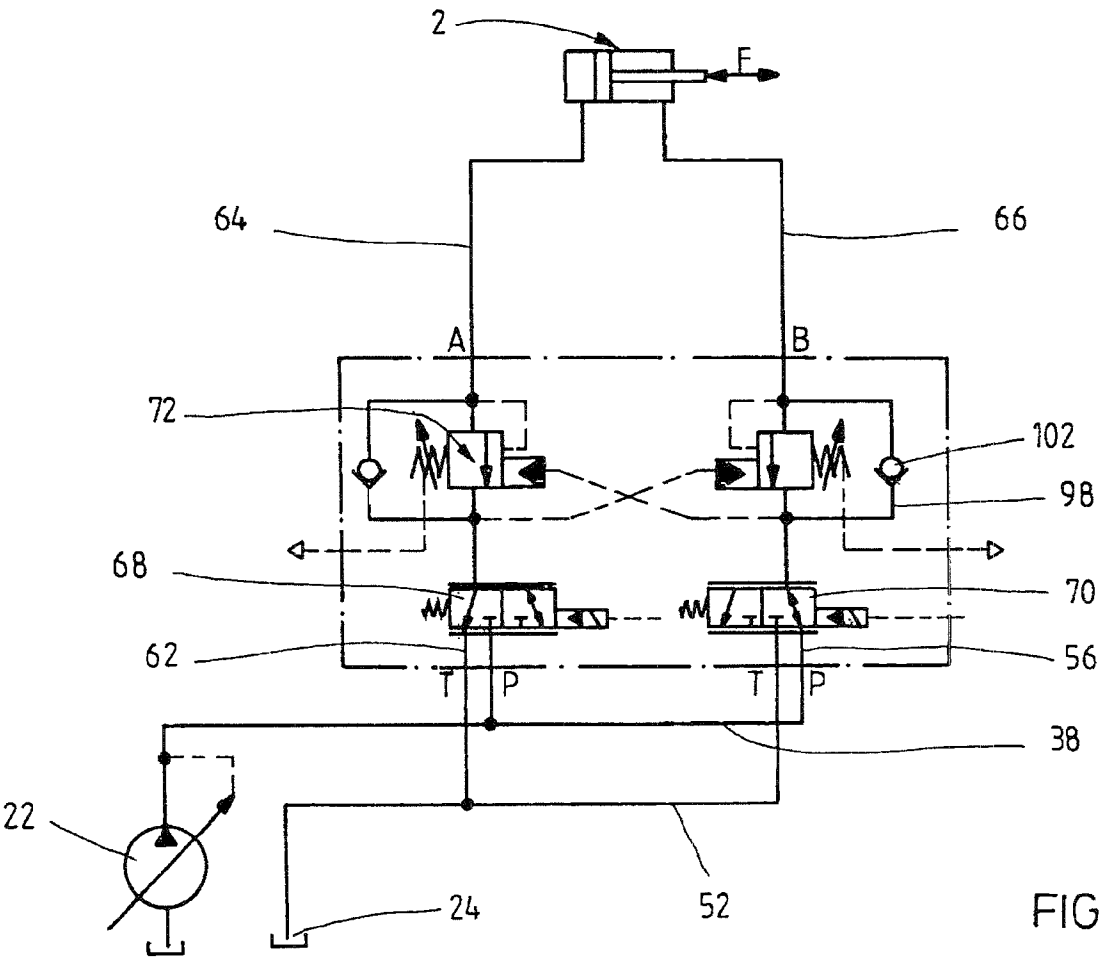
FIG. 5 shows the control system according to FIG. 2 when the cylinder is retracting and with a pushing or pulling load.

With a retracting cylinder and a pulling or pushing load, the directional control valve section 18 is switched into the position shown in FIG. 5 in which the directional control valve 68 opens the pressure fluid connection to the tank 24 and the pump 22 conveys pressure fluid into the annular chamber 14 via the directional control valve 70. The pressure in the inlet to the annular chamber 14 then depends on the load, the opening cross section of the directional control valve 70, and the set pump pressure. The pressure fluid is conveyed via the bypass conduit 98 and the opening check valve 102 and via the return line 66 into the annular chamber 14 and flows out of the contracting pressure chamber 10 and into the tank 24 via the supply line 64, the load lowering valve 72 that has been opened by the pressure in the inlet (connecting conduit 78), the directional control valve 68 that has been moved in the direction of its neutral position, and the outlet line 62. In this case, the load lowering valve 72 limits the pressure level in the outlet. Depending on the load direction, the pressure level in the inlet lies between the maximum pump pressure and 0 bar (pushing load, minimum retraction speed).

Figure 6:
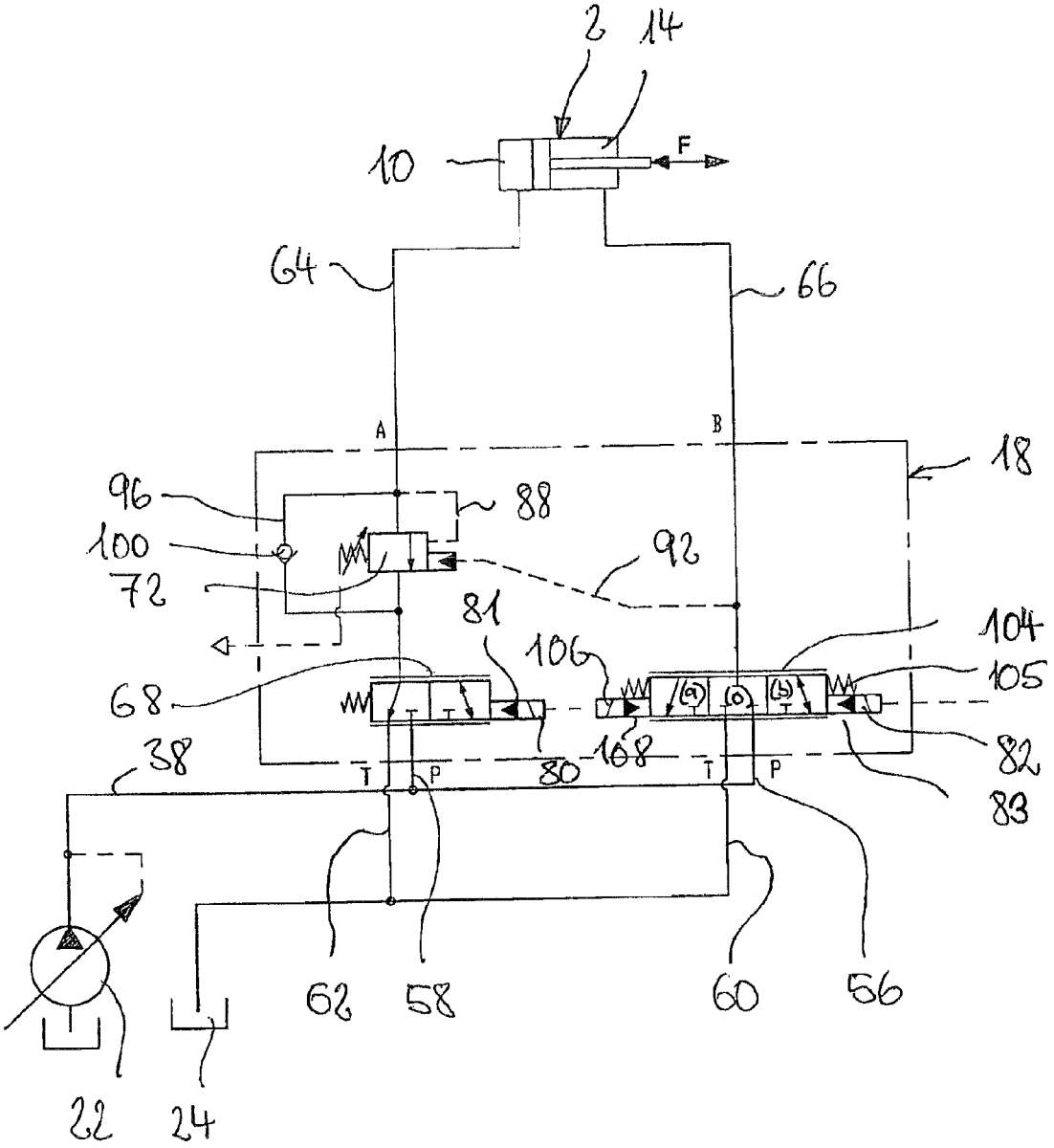
FIG. 6 shows a simplified embodiment of the directional control valve section from FIG. 2.

FIG. 6 shows a simplified exemplary embodiment of the control system 1 according to FIG. 2. The sole difference between it and the above-described exemplary embodiment according to FIG. 2 lies in the fact that the line that is connected to the consumer 2 and is referred to as the return line 66 contains neither a load lowering valve nor an associated directional control valve equipped with two so-called "switching positions," but is instead provided with a single continuously adjustable directional control valve 104, which is prestressed into a home position (0) by a centering spring arrangement 105 and can be moved in the direction of the positions (a) and (b) shown in FIG. 6 through actuation of two pilot valves 108, 83. The two pilot valves 83, 108—as in the above-described exemplary embodiment—are embodied as pressure reduction valves that can each be triggered by means of a respective proportional magnet 82, 106. The design of the valves embodied in the supply line 64—with the load lowering valve 72, the check valve 100, and the directional control valve 68 prestressed into an open position, which can only be moved in one direction by means of a single pilot valve 81—and the pressure fluid supply correspond to those of the above-described exemplary embodiment, rendering explanations of them unnecessary. For the sake of simplicity, the hydraulic components that correspond to one another have been provided with the same reference numerals as in the exemplary embodiment described at the beginning and the reader is referred to the description given with regard to them.

In the depicted home position (0) of the continuously adjustable directional control valve 104, the pressure fluid connection between the outlet line 60, the inlet line 56, and the return line 66 is closed. When the proportional magnet 106 is supplied with current, the pressure reducing valve 108 can be used to set a control pressure so that the valve slider of the directional control valve 104 is moved toward the right in the direction of the position labeled (a) in which the connection between the return line 66 and the outlet line 60 is opened. The pressure fluid connection to the inlet line 56 remains closed. When the pilot valve 83 is triggered, the valve slider of the directional control valve 104 is moved in the direction of position (b) so that the pressure fluid connection between the inlet line 56 and the return line 66, which is then functioning as a supply line, is correspondingly opened; the pressure fluid connection between the return line 66 and the outlet line 60 is closed.

The actuation of the load lowering valve 72 situated in the supply line 64 is carried out—as in the exemplary embodiment described at the beginning—by means of the pressure in the return line 66.

Naturally, the directional control valve 104 can also be integrated into the supply line 64 so that the load lowering valve 74 and the directional control valve 70 from FIG. 2 remain situated in the return line 66.

In order to retract the hydraulic cylinder (consumer 2), the directional control valve 104 is moved in the direction of its position of its positions (b) (sic) so that the variable displacement pump 22 conveys pressure fluid to the annular chamber 14 of the consumer via the pump line 38, the inlet line 56, the directional control valve 104, and the return line 66, which is then functioning as an inlet line. The directional control valve 104 is then used to correspondingly set the volumetric flow of pressure fluid and also the effective pressure in the annular chamber 14. The pressure in the return line 66 is used to move the load lowering valve 72 into its open position so that for example with a pushing load, cavitations are prevented since the consumer 2 remains restrained. With a pulling load, the load lowering valve 72 is completely or almost completely opened by the pressure in the supply, which pressure is tapped via the opening line 92, thus allowing the pressure fluid to flow out into the tank 24 via the load lowering valve 72 and the correspondingly set directional control valve 68.

During the extending movement of the consumer (hydraulic cylinder 2), the control system can also be operated once again in the regeneration mode; then the pilot valve 81 is used to switch the directional control valve 68 and the pilot valve 83 is used to move the directional control valve 104 toward its position (b) so that the pressure fluid flows out of the annular chamber 14 via the directional control valve 104, into the inlet line 58 and from there, via the directional control valve 68 and the check valve 100, the bypass conduit 96, and the supply line 64 to the pressure chamber 10 so that the consumer 2 is extended at a high speed. To exert a greater force, the directional control valve 104 is moved toward its position (a) so that the pressure fluid flows out of the annular chamber 14 into the tank 24. For further details about the various operating modes, please refer to the preceding explanations.

The switching from regeneration to normal operation preferably occurs automatically when the pump achieves the maximum pressure in the regeneration mode and the swivel angle is reset. As already mentioned at the beginning, further details regarding the pump control are explained in the patent application filed in parallel with the present one. The variable displacement pump 22 can be embodied with a swivel angle sensor for determining the swivel angle.

The present application has disclosed a hydraulic control system for supplying pressure fluid to at least one consumer; the supply and/or return of the consumer contain(s) a continuously adjustable directional control valve, which has two switching positions, and a load lowering valve that can be brought into an open position by the pressure in the inlet. The directional control valve is embodied with an open neutral position and can be electrically or electrohydraulically moved out of this neutral position in the direction toward its second switching position.

What is claimed is:

1. A hydraulic control system for supplying pressure fluid to at least one consumer (2, 4), comprising:

an electrical control unit (6); and an electric or electrohydraulic continuously adjustable valve device (18, 20) via which it is possible to connect a supply-side pressure chamber of the consumer (2, 4) to a pump (20) and to connect a return-side pressure chamber of the consumer (2, 4) to a tank (24), wherein the valve device has a first load lowering valve (72, 74) disposed in a supply line (64, 66) connecting the supply-side pressure chamber with the pump (22); a second load lowering valve (72, 74) situated in a return line connecting the return-side pressure chamber with the tank (24) and which is acted on in the direction of its opening position by the pressure in the supply line (64, 66); a first continuously adjustable directional control valve (68, 70) that is situated in the supply line (64, 66) between the first load lowering valve (72, 74) on the one hand and the pump (22) and the tank on the other hand and by means of which the connection of the supply-side pressure chamber with the pump (22) and with the tank (24) is controlled; and a second continuously adjustable directional valve (70, 68), which is disposed in the return line (66,64) between the second load lowering valve (74, 72) on the one hand and the pump (22) and the tank (24) on the other hand and by means of which a connection of the return-side pressure chamber with the pump (22) and with the tank (24) is controlled, wherein the first and second directional valves (68, 70) have an open neutral position, in which the first and second load-lowering valves (72, 74) are connected with the tank (24) and wherein the first directional valve (68, 70) or the second directional valve (70, 68) are actuatable by the control unit (6) from the neutral position, such that one of the first and second load lowering valves (72, 74) is connected with the pump (22) and the other of the first and second lower valves (70, 68) is connected with the tank (24), and wherein both first and second directional valves (68, 70) are actuatable simultaneously from the neutral position, such that both the first and second load-lowering valves (72, 74) are connected with the pump (22).

2. The hydraulic control system as reciting claim 1, wherein the inlet and the outlet each contain a respective load lowering valve (72, 74); the load lowering valve (72, 74) contained in the return is acted on in the direction of its open position by the respective pressure in the supply and the valve device (18, 20) has continuously adjustable directional control valves (68, 70) that are situated in the return and in the supply and have two switching positions, one of which is an open neutral position.

3. The hydraulic control system as recited in claim 1, wherein the load lowering valve (72, 74) is embodied with a pressure limiting function.

4. The hydraulic control system as recited in claim 1, having a bypass conduit (96), which bypasses the load lowering valve (72, 74) and contains a check valve (100, 102) that opens toward the consumer (2, 4).

5. The hydraulic control system as recited in claim 1, wherein a valve element of the load lowering valve (72, 74) is prestressed into a closed position by means of a spring (84, 86) whose spring chamber is discharged to the atmosphere.

6. The hydraulic control system as recited in claim 1, wherein the load lowering valve (72, 74) is situated in the supply direction downstream of the respective directional control valve (68, 70).

7. The hydraulic control system as recited in claim 1, wherein the valve device (18, 20) is situated on the housing of the consumer (2, 4).

8. The hydraulic control system as recited in claim 1, wherein the pump (22) is embodied as electrically or electrohydraulically adjustable and it is possible to regulate the pump pressure by means of a control loop equipped with a pump controller.

9. The hydraulic control system as recited in claim 8, wherein a triggering signal for the pump (22) is a measure for a swivel angle of the pump.

* * * * *